US011657960B2

(12) United States Patent
Bai et al.

(10) Patent No.: US 11,657,960 B2
(45) Date of Patent: May 23, 2023

(54) SINTERED BODY, SINTERED PERMANENT MAGNET AND PREPARATION METHODS THEREOF

(71) Applicant: Baotou Tianhe Magnetics Technology Co., Ltd., Baotou (CN)

(72) Inventors: Suo Bai, Baotou (CN); Shujie Wu, Baotou (CN); Yi Dong, Baotou (CN); Zhimin Wu, Baotou (CN); Shuai Zhang, Baotou (CN); Bo Yuan, Baotou (CN); Yi Yuan, Baotou (CN); Ya Chen, Baotou (CN); Wenjie Yuan, Baotou (CN)

(73) Assignee: Baotou Tianhe Magnetics Technology Co., Ltd.

( * ) Notice: Subject to any disclaimer, the term of this patent is extended or adjusted under 35 U.S.C. 154(b) by 305 days.

(21) Appl. No.: 16/821,180

(22) Filed: Mar. 17, 2020

(65) Prior Publication Data

US 2021/0050150 A1 Feb. 18, 2021

(30) Foreign Application Priority Data

Aug. 16, 2019 (CN) ..... 201910759260.X

(51) Int. Cl.
*H01F 41/02* (2006.01)
*H01F 1/057* (2006.01)

(52) U.S. Cl.
CPC ..... *H01F 41/0293* (2013.01); *H01F 1/0577* (2013.01)

(58) Field of Classification Search
None
See application file for complete search history.

(56) References Cited

U.S. PATENT DOCUMENTS

| | | | | |
|---|---|---|---|---|
| 2010/0051139 | A1* | 3/2010 | Nagata | C22C 38/16 148/101 |
| 2010/0164663 | A1 | 7/2010 | Nagata et al. | |
| 2013/0026870 | A1* | 1/2013 | Baba | C22C 38/005 427/127 |
| 2013/0271248 | A1 | 10/2013 | Nagata et al. | |
| 2014/0290803 | A1 | 10/2014 | Kato et al. | |
| 2016/0180993 | A1* | 6/2016 | Kanada | C22C 38/002 252/62.55 |
| 2016/0189838 | A1* | 6/2016 | Nishiuchi | C22C 38/00 148/302 |
| 2016/0293303 | A1 | 10/2016 | Hirota et al. | |
| 2017/0140856 | A1 | 5/2017 | Hirota et al. | |
| 2019/0172616 | A1 | 6/2019 | Doto et al. | |
| 2020/0082962 | A1* | 3/2020 | Ohashi | C22C 38/14 |

FOREIGN PATENT DOCUMENTS

| | | | | | |
|---|---|---|---|---|---|
| CN | 101447268 | A | * | 6/2009 | |
| CN | 101506919 | A | | 8/2009 | |
| CN | 102181820 | A | | 9/2011 | |
| CN | 102903472 | A | * | 1/2013 | |
| CN | 103377791 | A | | 10/2013 | |
| CN | 103745823 | A | | 4/2014 | |
| CN | 104505206 | A | * | 4/2015 | |
| CN | 106024252 | A | | 10/2016 | |
| CN | 106710766 | A | | 5/2017 | |
| CN | 108269667 | A | | 7/2018 | |
| CN | 108389673 | A | * | 8/2018 | |
| DE | 102014104425 | A1 | | 10/2014 | |
| EP | 2980808 | A1 | | 2/2016 | |
| EP | 3054461 | A1 | * | 8/2016 | B22F 3/24 |
| EP | 3514813 | A1 | | 7/2019 | |
| FR | 3044161 | A1 | * | 5/2017 | C22C 28/00 |
| JP | 2009231391 | A | * | 10/2009 | |
| JP | 2016129217 | A | * | 7/2016 | B22F 3/10 |
| KR | 1020150073638 | A | * | 1/2015 | |

OTHER PUBLICATIONS

CN 108389673 machine translation (Year: 2018).*
JP 2009-231391 machine translation (Year: 2009).*
CN 101447268 machine translation (Year: 2009).*
FR 3044161 machine translation (Year: 2017).*
CN 102903472 machine translation (Year: 2013).*
CN 104505206 machine translation (Year: 2015).*
JP 2016129217 machine translation (Year: 2016).*
KR 1020150073638 machine translation (Year: 2015).*
Chinese Search Report for Application No. 201910759260.X, dated Sep. 29, 2020, pp. 1-3.
Extended European Search Report including Written Opinion for Application No. EP20162909.4, dated Oct. 7, 2020, pp. 1-9.

* cited by examiner (Continued)

*Primary Examiner* — Paul A Wartalowicz
*Assistant Examiner* — Stephani Hill
(74) *Attorney, Agent, or Firm* — Lerner David LLP

(57) ABSTRACT

Disclosed is a sintered body composition used in improved diffusion efficiency of heavy rare earth elements RH, and related sintered permanent magnet and preparation methods. The sintered body includes $Nd_2Fe_{14}B$ crystal phase as a primary phase, and a rare earth rich phase as a grain boundary phase. The sintered body includes a composition expressed by $R_aB_bGa_cCu_dAl_eM_fCo_gFe_{balance}$; wherein R is one or more selected from rare earth elements, and R includes Nd; M is one or more selected from the group consisting of Zr, Ti, and Nb; and wherein "a" satisfies $13\% \le a \le 15.3\%$; "b" satisfies $5.4\% \le b \le 5.8\%$; "c" satisfies $0.05\% \le c \le 0.25\%$; "d" satisfies $0.08\% \le d \le 0.3\%$; "e" satisfies $0 \le e \le 1.2\%$; "f" satisfies $0.08\% \le f \le 0.2\%$; and "g" satisfies $0.8\% \le g \le 2.5\%$. Grains in $Nd_2Fe_{14}B$ crystal phase have average size L of 4-8 μm, and the relationship between L and t for grain boundary phases average thickness is: $\sigma = t/L$, wherein σ is defined as $0.009 \le \sigma \le 0.012$.

1 Claim, No Drawings

SINTERED BODY, SINTERED PERMANENT MAGNET AND PREPARATION METHODS THEREOF

CROSS REFERENCE TO RELATED APPLICATIONS

This application claims priority from Chinese application number 201910759260X, filed Aug. 16, 2019, the disclosure of which is hereby incorporated herein by reference.

TECHNICAL FIELD OF THE DISCLOSURE

The present disclosure relates to a sintered body and a preparation method thereof and also relates to a sintered permanent magnet and a preparation method thereof.

BACKGROUND OF THE DISCLOSURE

Nowadays, a R—Fe—B sintered body with a primary phase of $R_2Fe_{14}B$ has the highest performance among permanent magnets. It has been widely applied in motors for electric vehicles (EV, HV, PHV, etc.), industrial motors, air-conditioning compressors, etc. These motors require that the magnet has a high coercive force $H_{cj}$ and a high remanence Br in a high temperature environment.

The R—Fe—B sintered body prepared by a traditional preparation method has a high magnetic energy product BH and a high coercive force $H_{cj}$. The coercive force can be further improved by replacing a part of R in $R_2Fe_{14}B$ with a heavy rare earth element RH. In the R—Fe—B sintered body, a large amount of the heavy rare earth element RH will result in a reduction of the residual magnetic flux density. In addition, the heavy rare earth element RH is quite expensive, so a large amount of heavy rare earth element RH may lead to a quite high cost of the magnet.

In recent years, a grain boundary diffusion method has been applied to increase the coercive force $H_{cj}$ of the R—Fe—B sintered body. The heavy rare earth element RH is diffused into the R—Fe—B sintered body from its surface, so that a core-shell structure may be formed at the grain boundaries of the primary phase, so as to achieve a high coercive force $H_{cj}$, and to suppress a decrease in the remanence Br.

CN103377791A discloses a rare earth sintered body. The rare earth sintered body is an anisotropic sintered body, which comprises $Nd_2Fe_{14}B$ crystal phase as primary phase and has a composition $R1_aT_bM_cSi_dB_e$, wherein R1 is rare earth elements including Sc and Y; T is Fe and/or Co, M is at least one element selected from the group consisting of Al, Cu, Zn, In, P, S, Ti, V, Cr, Mn, Ni, Ga, Ge, Zr, Nb, Mo, Pd, Ag, Cd, Sn, Sb, Hf, Ta and W; Dy and/or Tb is diffused into the sintered body from its surface. Due to the usage of heavy rare earth elements RH and the volume of the sintered body, diffusion of Dy and/or Tb in the sintered body is so insufficient that the coercive force cannot be dramatically improved.

CN102181820A discloses a method for enhancing the coercive force of Nd—Fe—B magnet material. The method comprises the following steps: immersing a Nd—Fe—B magnet material in a mixed liquor of rare earth fluoride powder and anhydrous alcohol, so as the mixed liquor is coated on the surface of the Nd—Fe—B magnet material; then putting the Nd—Fe—B magnet material coated with the mixed liquid on its surface into a vacuum heating furnace for a permeation treatment; finally, performing an aging treatment. This method requires a large amount of the rare earth fluoride powder, so the production cost is increased. In addition, it results in reducing a residual magnetic flux density.

CN101506919A discloses a method for manufacturing a permanent magnet. A Nd—Fe—B sintered magnet and a heavy rare earth Dy are disposed with an inter-space between them in a treatment chamber; subsequently, the treatment chamber is heated in vacuum, so that the temperature of the sintered magnet is raised to a given temperature and simultaneously Dy is evaporated. The evaporated heavy rare earth Dy atoms are supplied to the surface of the sintered magnet and attached thereon. In this stage, the mass of heavy rare earth Dy atoms supplied to the sintered magnet is controlled, so that Dy is uniformly diffused into the grain boundary phase of the sintered magnet prior to the formation of any Dy layer on the surface of the sintered magnet. However, this manufacturing method is complicated and it is difficult to be controlled.

SUMMARY OF THE DISCLOSURE

In view of this, an object of the present disclosure is to provide a sintered body which can improve the diffusion efficiency of heavy rare earth elements RH, so as to reduce the amount of the heavy rare earth elements RH, further to decrease the production cost.

Another object of the present disclosure is to provide a method for preparing the sintered body.

A further object of the present disclosure is to provide a sintered permanent magnet which has a high coercive force $H_{cj}$ and a high remanence Br with a low content of the heavy rare earth elements RH.

Another further object of the present disclosure is to provide a method for preparing the sintered permanent magnet.

In accordance to an aspect of the present disclosure, there is provided a sintered body suitable for diffusion of heavy rare earth elements RH, comprising $Nd_2Fe_{14}B$ crystal phase as a primary phase and a rare earth rich phase as a grain boundary phase and having a composition expressed by a composition formula $R_aB_bGa_cCu_dAl_eM_fCo_gFe_{balance}$;

wherein R is at least one selected from rare earth elements, and R must comprise Nd;

M is at least one selected from the group consisting of Zr, Ti, and Nb;

a is an atomic percentage of R satisfying $13\% \le a \le 15.3\%$, based on all elements in the sintered body;

b is an atomic percentage of B satisfying $5.4\% \le b \le 5.8\%$, based on all elements in the sintered body;

c is an atomic percentage of Ga satisfying $0.05\% \le c \le 0.25\%$, based on all elements in the sintered body;

d is an atomic percentage of Cu satisfying $0.08\% \le d \le 0.3\%$, based on all elements in the sintered body;

e is an atomic percentage of Al satisfying $0 \le e \le 1.2\%$, based on all elements in the sintered body;

f is an atomic percentage of M satisfying $0.08\% \le f \le 0.2\%$, based on all elements in the sintered body;

g is an atomic percentage of Co satisfying $0.8\% \le g \le 2.5\%$, based on all elements in the sintered body;

wherein grains in $Nd_2Fe_{14}B$ crystal phase have an average size L of 4-8 μm, grain boundary phases have an average thickness t with a unit of μm; the relation of t and L is as following:

$$\sigma = t/L \tag{1}$$

σ is defined as $0.009 \le \sigma \le 0.012$.

According to the sintered body suitable for diffusion of heavy rare earth element RH of the present disclosure, preferably, (1) R does not comprise La or Ce; or (2) R comprises La and/or Ce, but the sum of the atomic percentages of both La and Ce is less than 1%.

According to the sintered body suitable for diffusion of heavy rare earth elements RH of the present disclosure, preferably, x is defined as $x=(\frac{2}{3}\alpha+\beta+\frac{2}{3}\gamma)\times 100$, and accordingly atomic percentage of oxygen α, atomic percentage of nitrogen β, atomic percentage of carbon γ in the sintered body and x meet the following relation:

$$x\leq 1.2 \quad (2)$$

$$0\leq e\times 100\leq 0.083\times(a\times 100-x)+0.025 \quad (3)$$

According to the sintered body suitable for diffusion of heavy rare earth elements RH of the present disclosure, preferably, the atomic percentages of B and Ga meet the following relation:

$$0.025b\times 100-0.1\leq c\times 100\leq 0.045b\times 100 \quad (4)$$

According to another aspect of the present disclosure, there is provided a method for preparing a sintered body suitable for diffusion of heavy rare earth elements RH, comprising the following steps:

(a) smelting raw materials of the sintered body to obtain a master alloy sheet;

(b) making the master alloy sheet into magnetic powder;

(c) pressing the magnetic powder in a magnetic field, and then performing an isostatical pressing treatment to obtain a green body;

(d) subjecting the green body to a first vacuum heat treatment, a second vacuum heat treatment, and a third vacuum heat treatment to obtain the sintered body.

According to the method for preparing the sintered body suitable for diffusion of heavy rare earth elements RH of the present disclosure, preferably, the master alloy sheet has a thickness of 0.15-0.4 mm; the magnetic powder has an average particle size D50 of 2.2-5.5 μm, and the ratio of the particle size D90 to the particle size D10 is less than 5.5; the magnetic field has an intensity of more than 1.5T, and the green body has a density of 3.2-5 g/cm$^3$.

According to the method for preparing a sintered body suitable for diffusion of heavy rare earth elements RH of the present disclosure, preferably, the first vacuum heat treatment is performed under conditions of a vacuum degree of below or equal to $5.0\times10^{-3}$Pa and a temperature of 800-1200° C. for a processing time of 1-10 h; the second vacuum heat treatment is performed under conditions of a vacuum degree of below or equal to $5.0\times10^{-1}$ Pa and a temperature of 600-1100° C. for a processing time of 1-5 h;the third vacuum heat treatment is performed under conditions of a vacuum degree of below or equal to $5.0\times10^{-1}$ Pa and a temperature of 300-800° C. for a processing time of 2-6 h.

In accordance to a further aspect of the present disclosure, there is provided a sintered permanent magnet obtained by diffusing heavy rare earth elements RH into the sintered body from its surface; wherein the heavy rare earth elements RH comprises Dy and/or Tb.

In accordance to another further aspect of the present disclosure, there is provided a method for preparing the sintered permanent magnet, comprising the following steps:

attaching a substance containing heavy rare earth elements RH to the surface of the sintered body of the present disclosure, so as to obtain a magnet attached with heavy rare earth elements RH; wherein the weight ratio of the heavy rare earth elements RH to the sintered body is 0.002-0.01:1;

subjecting the magnet attached with heavy rare earth elements RH to a first heat treatment and a second heat treatment under vacuum conditions to obtain the sintered permanent magnet.

According to the method for preparing the sintered permanent magnet of the present disclosure, preferably, the first heat treatment is performed under conditions of a vacuum degree of below or equal to $5.0\times10^{-2}$Pa and a temperature of 850-950° C. for a processing time of 6-9 h; the second heat treatment is performed under conditions of a vacuum degree of below or equal to $5.0\times10^{-2}$ Pa and a temperature of 400-560° C. for a processing time of 4.5-5.5 h.

In the present disclosure, the diffusion efficiency of heavy rare earth elements RH in the sintered body is improved by adjusting the proportion of each element in the sintered body. The sintered body becomes more suitable for diffusion of the heavy rare earth elements RH by selecting a suitable vacuum heat treatment process. The heavy rare earth elements RH are diffused into the sintered body to form a sintered permanent magnet, which has a high coercive force $H_{cj}$ and a high remanence Br.

DETAIL DESCRIPTION OF THE DISCLOSURE

The present disclosure will be further explained in combination with specific embodiments, but the protection scope of the present disclosure is not limited thereto.

The "remanence" in the present disclosure refers to the value of the magnetic flux density at the point where the magnetic field strength is zero on the saturated magnetic hysteresis loop, and is commonly referred to as Br or Mr, with the unit of Tesla (T) or Gauss (Gs). 1 Gs=0.0001 T.

The "coercive force" in the present disclosure also called intrinsic coercive force, refers to the reverse magnetic field strength that makes magnetization of the magnet, which is in its saturated magnetization state, along saturated magnetic hysteresis loop decrease to zero when the magnetic field is monotonously reduced to zero and increased in the opposite direction. It is commonly referred to as $H_{cj}$ or $MH_c$, with the unit of Oersted (Oe) of Ampere/Meter (A/m).1 Oe=79.6 A/m.

The squareness ratio in the present disclosure is expressed by $Hk/H_{cj}$. The magnetic field Hk of bending point is the magnetic field at the point on the demagnetization curve where J=0.9 Br. It is also called knee-point coercive force. $H_{cj}$ is the intrinsic coercive force at room temperature.

The rare earth element in the present disclosure comprises, but is not limited to, Praseodymium, Neodymium, or "heavy rare earth elements RH". The "heavy rare earth elements RH" in the present disclosure are also called "Yttrium group elements", comprise nine elements of Yttrium (Y), Gadolinium (Gd), Terbium (Tb), Dysprosium (Dy), Holmium (Ho), Erbium (Er), Thulium (Tm), Ytterbium (Yb), Lutetium (Lu).

The "inert atmosphere" in the present disclosure refers to an atmosphere that does not react with the magnet and does not affect its magnetism. In the present disclosure, the "inert atmosphere" comprises an atmosphere of an inert gas (helium, neon, argon, krypton, xenon).

The "vacuum" in the present disclosure refers to the absolute vacuum degree; the smaller the value is, the higher the vacuum degree is.

The "average particle size D50" in the present disclosure means the equivalent diameter of the largest particle when the cumulative distribution in the particle size distribution curve is 50%.

The "average particle size D90" in the present disclosure means the equivalent diameter of the largest particle when the cumulative distribution in the particle size distribution curve is 90%.

The "average particle size D10" in the present disclosure means the equivalent diameter of the largest particle when the cumulative distribution in the particle size distribution curve is 10%.

<Sintered Body>

In the present disclosure, a sintered body means a sintered body without a diffusion treatment of the heavy rare earth elements RH, and sometime may be a sintered base material. The sintered body in the present disclosure comprises a $Nd_2Fe_{14}B$ crystal phase and a rare earth rich phase; wherein the $Nd_2Fe_{14}B$ crystal phase is a primary phase, and the rare earth rich phase is a grain boundary phase. The composition of the sintered body in the present disclosure is expressed by a composition formula $R_aB_bGa_cCu_dAl_eM_fCo_gFe_{balance}$. R is at least one selected from rare earth elements, and R must comprise Nd. Said at least one rare earth elements comprise Praseodymium (Pr), Neodymium (Nd), Terbium (Tb), and Dysprosium (Dy). Preferably, R comprises Nd, and comprises one element selected from Praseodymium (Pr) and Dysprosium (Dy). More preferably, R comprises Nd and Pr.

In the present disclosure, M is at least one selected from the group consisting of Zr, Ti, and Nb; preferably M is at least one selected from the group consisting of Zr and Nb; more preferably, M is Zr.

In the present disclosure, a, b, c, d, e, f, and g are atomic percentages (at %) of each element based on all elements in the sintered body.

a is an atomic percentage of R satisfying 13%≤a≤15.3%, based on all elements in the sintered body; preferably 13%≤a≤15.2%; and more preferably 13%≤σ≤15%. When the content of R is less than 13%, the coercive force $H_{cj}$ of the magnet is low; when the content of R is more than 15.6%, the percentage of primary phase in the magnet is reduced, resulting in a significant decrease in the remanence Br of the magnet.

b is an atomic percentage of B satisfying 5.4%≤b≤5.8%, based on all elements in the sintered body; preferably 5.5%≤b≤5.75%; and more preferably 5.6%≤b≤5.75%. When the content of B is less than 5.4%, $R_2Fe_{17}$ tends to be formed and the percentage of primary phase is reduced, which results in a reduced remanence Br and a deteriorated squareness ratio $Hk/H_{cj}$; when the content of B is more than 5.8%, the percentage of primary phase is relatively high, and thus the squareness ratio $Hk/H_{cj}$ tends to be deteriorated, it is difficult to form a continuous grain boundary phase with a sufficient width, and it is not conducive to diffusion of the heavy rare earth elements RH.

c is an atomic percentage of Ga satisfying 0.05%≤c≤0.25%, based on all elements in the sintered body; preferably 0.1%≤c≤0.2%; and more preferably 0.1%≤c≤0.15%. When the content of Ga is less than 0.05%, the coercive force $H_{cj}$ is low, which is also not conducive to diffusion of the heavy rare earth elements RH. When the content of Ga is greater than 0.25%, both the remanence Br and the squareness ratio $Hk/H_{cj}$ are reduced.

d is an atomic percentage of Cu satisfying 0.08%≤d≤0.3%, based on all elements in the sintered body; preferably 0.08%≤d≤0.28%; and more preferably 0.08%≤d≤0.25%. An appropriate amount of Cu may increase the coercive force $H_{cj}$ of the magnet. When the content of Cu is less than 0.08%, the coercive force $H_{cj}$ is relatively low. When the content of Cu is more than 0.3%, the percentage of primary phase decreases, so that a sufficiently high remanence Br cannot be obtained. In addition, excessive Cu may result in the formation of a large number of $Nd_6Fe_{13}Cu$ grain boundary phases. Thus, it is difficult to improve the diffusion efficiency of the heavy rare earth elements RH.

e is an atomic percentage of Al satisfying 0≤e≤1.2%, based on all elements in the sintered body; preferably 0≤e≤1.0%; and more preferably 0≤e≤0.5%. The content of Al plays an important role in diffusion of the heavy rare earth elements RH. It has been found that the diffusion efficiency of heavy rare earth elements RH becomes deteriorated as the content of Al increases, and accordingly an increasing extent of the coercive force $H_{cj}$ of the magnet decreases. Therefore, it is very important to control the content of Al in a lower range.

f is an atomic percentage of M satisfying 0.08%≤f≤0.2%, based on all elements in the sintered body; preferably 0.09%≤f≤0.18%; and more preferably 0.1%≤f≤0.16%. M is at least one selected from the group consisting of Zr, Ti and Nb; preferably M is at least one selected from the group consisting of Zr and Nb; more preferably, M is Zr. M forms high melting point precipitates in the magnet, for example, in the form of boride, which inhibits the growth of grains during the sintering process. When the content of M is less than 0.08%, abnormally grown grains tend to appear in the sintering process, which results in a reduction of both the coercive force $H_{cj}$ and the squareness ratio $Hk/H_{cj}$. When the content of M is more than 0.2%, the percentage of primary phase decreases, and a sufficiently high remanence Br cannot be obtained, resulting in a deteriorated processability of the sintered body.

g is an atomic percentage of Co satisfying 0.8%≤g≤2.5%, based on all elements in the sintered body; preferably 1.0%≤g≤2.0%; and more preferably 1.0%≤g≤1.8%. Because the magnetization of grains in the primary phase of $R_2Fe_{14}B$ is relatively strong, the remanence Br of the magnet does not decrease significantly when a small amount of Co is added. In addition, Co may increase the Curie point of the magnet, and also improve the grain boundary structure of the magnet and enhance the high temperature resistance. When the content of Co is less than 0.8%, the remanence Br of the magnet does not decrease significantly, but the temperature coefficient and the corrosion resistance become deteriorated. When the content of Co is more than 2.5%, the remanence Br of the magnet at room temperature is reduced, resulting in a deteriorate processability of the sintered body.

In accordance to one embodiment of the present disclosure, 13%≤a≤15.3%, 5.4%≤b≤5.8%, 0.05%≤c≤0.25%, 0.08%≤d≤0.3%, 0≤e≤1.2%, 0.08%≤f≤0.2%, 0.8%≤g≤2.5%. In accordance to another embodiment of the present disclosure, a is 13%≤a≤15.2%, 5.5%≤b≤5.75%, 0.1%≤c≤0.2%, 0.08%≤d≤0.28%, 0≤e≤1.0%, 0.09%≤f≤0.18%, 1.0%≤g≤2.0%. In accordance to still another embodiment of the present disclosure, 13%≤a≤15%, 5.6%≤b≤5.75%, 0.1%≤c≤0.15%, 0.08%≤d≤0.25%, 0≤e≤0.5%, 0.1%≤f≤0.16%, 1.0%≤g≤1.8%. In this way, it is conducive to improving a diffusion efficiency of the heavy rare earth elements RH.

Grains in $Nd_2Fe_{14}B$ crystal phase of the present disclosure have an average size L of 4-8 μm, preferably 4.5-7.5 μm, and more preferably 5-7 μm. The grain boundary phase has an average thickness t, with a unit of μm. The relation of t and L is as following:

$$\sigma=t/L \quad (1)$$

σ is defined as $0.009\leq\sigma\leq0.012$. Preferably, $0.0095\leq\sigma\leq0.012$, and more preferably, $0.010\leq\sigma\leq0.011$.

The sintered body of the present disclosure has grains of $Nd_2Fe_{14}B$ type compound as a primary phase, and a rare earth rich phase with a low melting point between the grains as a grain boundary phase. It has been unexpectedly found that heavy rare earth elements RH can be sufficiently diffused into a sintered body by adopting the above-mentioned thickness of the grain boundary phase and the above-mentioned average grain size of the primary phase. The amount of heavy rare earth elements RH can be reduced, while the coercive force increases.

After repeated researches, it has been found that the diffusion efficiency of heavy rare earth elements RH is closely related to the composition and microstructure of the sintered body. Among them, the content and proportion of B, Ga, and Al, and the relation between specific grain size L and thickness t of the grain boundary phase play an important role in the diffusion effect of heavy rare earth elements RH in the sintered body. Some grain boundary phases, such as $R_6Fe_{13}Cu$, $R_6Fe_{13}Ga$, $R_2(Fe, Al)_{17}$, $R_6Fe_{11}Al_3$, and $R(Fe, Al)_2$, have a significant influence on the diffusion efficiency of heavy rare earth elements RH. Some grain boundary phases, especially grain boundary phases formed by $La_6Fe_nGa_3$ or $Nd_6Fe_{13}Ga$ structure type compounds and $R(Fe, Al)_2$ type compounds, may prevent heavy rare earth elements RH from forming epitaxial layers of $Dy_2Fe_{14}B$, $Tb_2Fe_{14}B$ on the surface of primary phase grains, limiting an increase in the coercive force $H_{cj}$. Therefore, the diffusion efficiency of heavy rare earth elements RH can be guaranteed by limiting these types of grain boundary phases in a certain range. In the present disclosure, the diffusion efficiency of heavy rare earth elements RH in the sintered body is improved by optimizing the content of R, B, Ga, Cu, Co, Al, Zr and Fe in the sintered body and limiting the average thickness of grain boundary phase and grains in the $Nd_2Fe_{14}B$ crystal phase.

The sintered body of the present disclosure is suitable for diffusion of the heavy rare earth elements RH. It has been found that La and Ce may form $La_2Fe_{14}B$ and $Ce_2Fe_{14}B$, which may deteriorate the magnetic properties of the sintered body. In the present disclosure, R of the sintered body does not contain La or Ce; or R contains La and/or Ce, but the sum of the atomic percentages of La and Ce is less than 1%. In accordance to an embodiment of the present disclosure, R does not contain La and Ce. In accordance to another embodiment of the present disclosure, R contains La and Ce, but the sum of atomic percentages of La and Ce is less than 1%; preferably, the sum of atomic percentages of La and Ce is less than 0.8%; more preferably, the sum of atomic percentages in R is less than 0.1%. In this way, it is conducive to improving the diffusion efficiency of heavy rare earth elements RH.

In the sintered body of the present disclosure, x is defined as $x=(\frac{2}{3}\alpha+\beta+\frac{2}{3}\gamma)\times100$, and accordingly atomic percentage of oxygen α, atomic percentage of nitrogen β, atomic percentage of carbon γ in the sintered body and x meet the following relation:

$$x\leq1.2 \quad (2)$$

$$0\leq e\times100\leq0.083\times(a\times100-x)+0.025 \quad (3)$$

During the manufacturing process of the sintered body, it is inevitable to introduce carbon, oxygen, nitrogen and other impurities, leading to a loss of the rare earth rich phase, further affecting the diffusion efficiency of heavy rare earth elements RH. It has been found that the diffusion efficiency of heavy rare earth elements RH into the sintered body can be further assured by controlling the content of carbon, oxygen, and nitrogen within the above-mentioned range and ensuring the content of Al within the above-mentioned range. The content of oxygen in the sintered body can be measured by using a gas analysis device based on a gas fusion-infrared absorption method. The content of nitrogen can be measured by using a gas analysis device based on a gas fusion-heat conduction method. The content of carbon can be measured by using a gas analysis device based on a combustion-infrared absorption method.

In the sintered body of the present disclosure, atomic percentages of B and Ga meet the following relation:

$$0.025b\times100-0.1\leq c\times100\leq0.045b\times100 \quad (4)$$

When the contents of B and Ga do not meet the above-mentioned relation, a large amount of $Nd_6Fe_{13}Ga$ type compounds tends to be formed, which is not conducive to diffusion of the heavy rare earth elements RH.

<Method for Preparing a Sintered Body>

The method for preparing a sintered body comprises the following steps: (a) smelting raw materials of a sintered body to obtain a master alloy sheet; (b) making the master alloy sheet into magnetic powder; (c) pressing the magnetic powder in a magnetic field, and then preforming an isostatical pressing treatment to obtain a green body; (d) subjecting the green body to a first vacuum heat treatment, a second vacuum heat treatment, and a third vacuum heat treatment to obtain the sintered body.

The sintered body prepared by the above-mentioned method comprises $Nd_2Fe_{14}B$ crystal phase as a primary phase and a rare earth rich phase as a grain boundary phase. Raw materials of the sintered body are obtained according to a composition expressed by a composition formula $R_aB_bGa_cCu_dAl_eM_fCo_gFe_{balance}$. The above-mentioned elements and their atomic percentages are as described above, which will not be repeated here. It is inevitable to introduce a small amount of carbon, oxygen, nitrogen in the preparation process. Their specific contents are as described above, and will not be repeated here.

In step (a), raw materials of a sintered body are smelted to obtain a master alloy sheet. In order to prevent raw materials of the sintered body or the master alloy made therefrom from oxidation, smelting is performed in a vacuum or inert atmosphere. An ingot casting process or a quick-setting strip casting process is preferable for the smelting process. The ingot casting process refers that the smelted raw materials of the sintered body are cooled and solidified so as to form an alloy ingot (master alloy). The quick-setting strip casting process refers that the smelted raw materials of the sintered body are rapidly cooled and solidified, casting into an alloy strip (master alloy). In accordance to an embodiment of the present disclosure, a quick-setting strip casting process is utilized in the smelting process. Compared with the ingot process, the quick-setting strip casting process can avoid the appearance of α-Fe that affects uniformity of the magnetic powder, and it can also avoid the appearance of agglomerated neodymium-rich phases, so that it is conducive to the size refinement of grains in primary phase of $Nd_2Fe_{14}B$ in the master alloy. The quick-setting strip casting process of the present disclosure is preferably performed in a vacuum quick-setting melting furnace. In step (a), the master alloy sheet has a thickness of 0.15-0.4 mm, preferably 0.2-0.35 mm, and more preferably 0.25-0.3 mm.

In step (b), the master alloy sheet is made into magnetic powder. In order to prevent the master alloy sheet and the magnetic powder produced therefrom from oxidization, the milling process of the present disclosure is performed in a vacuum or an inert atmosphere. The milling process comprises a coarse crushing step and a milling step. In the coarse crushing step, the master alloy sheet is crushed into magnetic particles with a relatively large particle size. In the milling step, magnetic particles are milled into magnetic powder.

In the coarse crushing step, a mechanical crushing process and/or a hydrogen crushing process are used to crush the master alloy into magnetic particles. In the mechanical crushing process, a mechanical crushing device is used to crush the master alloy into magnetic particles. The mechanical crushing device may be a jaw crusher or a hammer crusher. The hydrogen crushing process comprises the following steps: firstly making the master alloy absorb hydrogen, initializing a volume expansion of the master alloy crystal lattice through a reaction between master alloy and hydrogen, so that the master alloy is crushed into magnetic particles; and then heating the magnetic particles to perform de-hydrogen. In accordance to a preferable embodiment of the present disclosure, the hydrogen crushing process is preferably performed in a hydrogen crushing furnace. In the hydrogen crushing process of the present disclosure, the temperature for the hydrogen absorption is 50° C-400° C., preferably 100° C-300° C.; the pressure for the hydrogen absorption is 50-600 kPa, preferably 100-500 kPa; the temperature for the de-hydrogen is 500-1000° C., preferably 700-900° C. The magnetic particles obtained in the coarse crushing process may have an average particle size D50 of below or equal to 500 μm, preferably below or equal to 350 μm, and more preferably 100-300 μm.

In the milling step, the magnetic particles are crushed into magnetic powder by a ball milling process and/or a jet milling process. In the ball milling process, a mechanical ball milling device is used to crush the magnetic particles into magnetic powder. The mechanical ball milling device may be a rolling ball miller, a vibration ball miller, or a high-energy ball miller. In the jet milling process, a gas flow is used to accelerate the magnetic particles, so that the magnetic particles collide with each other and being crushed. The gas flow may be a nitrogen flow, preferably a high-purity nitrogen flow. The content of $N_2$ in the high-purity nitrogen flow may be above 99.0wt %, preferably above 99.9wt %. The pressure of the gas flow may be 0.1-2.0 MPa, preferably 0.5-1.0 MPa, and more preferably 0.6-0.7 MPa. The magnetic powder obtained in the milling process has an average particle size D50 of 2.2-5.5 μm, preferably 2.5-5 μm, and more preferably 3.6-4.5 μm. The ratio of D90/D10 is less than 5.5, preferably, the ratio of D90/D10 is less than 5, and more preferably, the ratio of D90/D10 is less than 4.3. The ratio of D90/D10 may indicate the particle size uniformity of magnetic powder.

In accordance to a preferred embodiment of the present disclosure, the master alloy sheet is firstly crushed into magnetic particles by a hydrogen crushing process; and then, the magnetic particles are crushed into magnetic powder by a jet mill process.

In step (c), the magnetic powder is pressed in a magnetic field, and then it is isostatically pressed to obtain a green body. To prevent the magnetic powder from oxidization, the pressing process and the isostatically pressing process are performed in a vacuum or an inert atmosphere. In the pressing process, a mould pressing process is preferably applied. The direction of orientated magnetic field and the pressing direction of magnetic powder are parallel to each other or perpendicular to each other. There is no particular restriction on the strength of orientated magnetic field, it depends on actual requirements. The magnetic field has an intensity of more than 1.5 T, preferably more than 1.75 T, and more preferably more than 1.85 T. The green body has a density of 2-5 g/cm$^3$; preferably, the green body has a density of 3.5-4.2 g/cm$^3$; more preferably, the green body has a density of 3.9-4.1 g/cm$^3$. The green body prepared by the above method is conducive to improving the diffusion efficiency of heavy rare earth elements RH.

In step (d), the green body is subjected to a first vacuum heat treatment, a second vacuum heat treatment, and a third vacuum heat treatment to obtain a sintered body. The diffusion efficiency of heavy rare earth elements RH into the sintered body may be improved by using such a vacuum heat treatment.

The first vacuum heat treatment is performed under a vacuum degree of below or equal to $5.0\times10^{-3}$ Pa, preferably below or equal to $4.5\times10^{-3}$ Pa, and more preferably below or equal to $4.0\times10^{-3}$ Pa. The first vacuum heat treatment is performed at a temperature of 800-1200° C., preferably 1000-1100° C., and more preferably 1045-1065° C. The first vacuum heat treatment is performed for a processing time of 1-10 h, preferably 2-8 h, and more preferably 2.5-7 h.

The second vacuum heat treatment is performed under a vacuum degree of below or equal to $5.0\times10^{-1}$ Pa, preferably below or equal to $4.5\times10^{-1}$ Pa, and more preferably below or equal to $4.0\times10^{-1}$ Pa. The second vacuum heat treatment is performed at a temperature of 600-1100° C., preferably 700-1000° C., and more preferably 850-950° C. The second vacuum heat treatment is performed for a processing time of 1-5 h, preferably 2-4 h, and more preferably 2.5-4.5 h.

The third vacuum heat treatment is performed under a vacuum degree of below or equal to $5.0\times10^{-1}$ Pa, preferably below or equal to $4.5\times10^{-1}$ Pa, and more preferably below or equal to $4.0\times10^{-1}$ Pa. The third vacuum heat treatment is performed at a temperature of 300-800° C., preferably 400-700° C., and more preferably 480-540° C. The third vacuum heat treatment is performed for a processing time of 2-6 h, preferably 3-6 h, and more preferably 4-5.5 h.

The preparation method of the present disclosure may further comprise a cutting step. A slicing process and/or an electric spark cutting process may be used for the cutting step. In the present disclosure, the sintered body is cut into ones with a thickness below 10 mm; preferably below 5 mm in one direction. Preferably, the direction in which the thickness is below 10 mm, preferably below 5 mm is the alignment direction of the sintered body. In the present disclosure, the sintered body is cut into ones with a thickness above 0.1 mm; preferably above 1 mm. It is conducive to improving the diffusion efficiency of heavy rare earth elements RH.

<Sintered Permanent Magnets>

A sintered permanent magnet is a magnetic material obtained by diffusing heavy rare earth elements RH, which is attached to its surface, from outside to inside. The sintered permanent magnet of the present disclosure is obtained by diffusing heavy rare earth elements RH into the sintered body from its surface. The heavy rare earth elements RH may comprise Dy and/or Tb. For the sintered body of the present disclosure, the heavy rare earth elements RH are sufficiently diffused into the sintered body from its surface, thereby the coercive force $H_{cj}$ of the sintered permanent magnet can be increased by at least 8 kOe, or even more than 10 kOe. Since the sintered body of the present disclosure is suitable for a full and rapid diffusion of heavy rare earth elements RH, the amount of the heavy rare earth elements RH may be controlled, so that the cost is reduced, while a higher coercive force $H_{cj}$ and a higher remanence Br are assured.

<Method for Preparing a Sintered Permanent Magnet>

The method for preparing a sintered body of the present disclosure comprises the following steps: preparing the sintered body, attaching and diffusion treatment. The steps of preparing the sintered body have been described above.

The steps of attaching and diffusion treatment are described in detail below.

In the step of attaching, a substance containing heavy rare earth elements RH is attached to the surface of the sintered body to obtain a magnet attached with heavy rare earth elements RH. The heavy rare earth elements RH comprise at least one of Dy and Tb. Preferably, RH is a mixture of Dy and Tb, or Tb. More preferably, RH is Tb. In the present disclosure, the weight ratio of the heavy rare earth elements RH in the substance containing heavy rare earth elements RH to the sintered body is (0.002-0.01):1, preferably (0.004-0.008):1, and more preferably (0.005-0.006):1. The coercive force $H_{cj}$ and the remanence Br of the sintered permanent magnet can be increased while the amount of heavy rare earths is decreased by using the above-mentioned weight ratio of the heavy rare earth elements RH to the sintered body.

The substance containing heavy rare earth elements RH is selected from:

a1) an elementary substance of the heavy rare earth elements RH;

a2) an alloy containing the heavy rare earth elements RH;

a3) a compound containing the heavy rare earth elements RH; or a4) any mixture of the above substances.

In addition to the heavy rare earth elements RH, the alloy containing the heavy rare earth elements RH a2) of the present disclosure contains other metal elements. Preferably, said other metal elements comprise at least one selected from the group consisting of Aluminum, Gallium, Magnesium, Tin, Iron, Niobium, Zirconium, Titanium, Platinum, Copper and Zinc, and is preferably at least one selected from the group consisting of Iron, Niobium, Zirconium, Titanium and Platinum.

The compound containing the heavy rare earth elements RH a3) of the present disclosure is an inorganic compound or an organic compound containing the heavy rare earth elements RH. The inorganic compound containing the heavy rare earth elements RH comprises, but is not limited to, an oxide, hydroxide, or inorganic acid salt of the heavy rare earth elements RH. The organic compound containing the heavy rare earth elements RH comprises, but is not limited to, an organic acid salt, alkoxide or metal complex containing the heavy rare earth elements RH. In accordance to a preferred embodiment of the present disclosure, the compound containing the heavy rare earth elements RH of the present disclosure is a halide of the heavy rare earth elements RH, such as a fluoride, chloride, bromide, or iodide of the heavy rare earth elements RH.

In the present disclosure, there is no restriction on the method of attaching. A sputtering coating method, a vapor deposition method, a dipping method, or other coating methods may be selected. A vacuum magnetron sputtering method or a vapor deposition method is preferred. A vacuum magnetron sputtering method is more preferred to perform attaching. Other methods of attaching include wet coating, dry coating, or a combination thereof.

Wet coating is preferably performed by the following coating processes or a combination thereof:

1) dissolving a substance containing the heavy rare earth elements RH in a liquid medium to form a coating solution in a form of solution, and coating the surface of the sintered Nd—Fe—B magnet with the coating solution in the form of solution;

2) dispersing a substance containing the heavy rare earth elements RH in a liquid medium to form a coating solution in a form of suspension or emulsion, and coating the surface of the sintered Nd—Fe—B magnet with the coating solution in the form of suspension or emulsion; or 3) providing a coating solution containing a substance containing the heavy rare earth elements RH Immersing the sintered Nd—Fe—B magnet in the coating solution, and forming a layer of the substance containing the rare earth elements on the surface of the sintered Nd—Fe—B magnet by chemical plating, electroplating, or electrophoresis.

In processes 1) and 2), there is no special restriction on the method of applying the coating solution. Conventional coating methods in the art may be applied, such as dip coating, brush coating, spin coating, spray coating, roll coating, screen printing, or ink-print. The liquid medium of the coating solution may be selected from water, an organic solvent, or a combination thereof.

In process 3), there is no special restriction on processes of chemical plating, electroplating, or electrophoresis. Conventional processes in the art may be applied.

Dry coating is preferably performed by the following coating processes or a combination thereof:

4) making a substance containing the heavy rare earth elements RH into a powder, and applying the powder on the surface of the sintered neodymium iron boron magnet; or 5) depositing a substance containing the heavy rare earth elements RH on the surface of the sintered Nd—Fe—B magnet through a vapor deposition process.

In process 4), it is preferable to use at least one selected from the group consisting of fluidized bed method, electrostatic powder spraying method, electrostatic fluidized bed method, and electrostatic powder oscillation method.

In process 5), it is preferable to use at least one selected from the group consisting of chemical vapor deposition (CVD) and physical vapor deposition (PVD).

In the step of diffusion treatment, the coated sintered permanent magnet is respectively subjected to a first heat treatment and a second heat treatment under vacuum conditions to obtain a sintered permanent magnet.

The first heat treatment is performed under a vacuum degree of below or equal to $5.0\times10^{-2}$ Pa, preferably below or equal to $3.0\times10^{-2}$ Pa, and more preferably below or equal to $2.0\times10^{-2}$ Pa. The first heat treatment is performed at a temperature of 850-950° C., preferably 880-950° C., and more preferably 900-950° C. The first heat treatment is performed for a processing time of 6-9 h, preferably 6.5-8.5 h, and more preferably 8 h.

The second heat treatment is performed under a vacuum degree of below or equal to $5.0\times10^{-2}$ Pa, preferably below or equal to $3.0\times10^{-2}$ Pa, and more preferably below or equal to $2.0\times10^{-2}$ Pa. The second heat treatment is performed at a temperature of 400-560° C., preferably 420-560° C., and more preferably 450-560° C. The second heat treatment is performed for a processing time of 3-6 h, preferably 3.5-6 h, and more preferably 4.5-5.5 h.

<Measurement Method>

Determination of Element Content:

Oxygen content α, nitrogen content β, and carbon content γ (at %) refer to those in the sintered body. The oxygen content may be measured with a gas analysis device based on a gas fusion-infrared absorption method. The nitrogen content may be measured with a gas analysis device based on a gas fusion-heat conduction method. The carbon content may be measured with a gas analysis device based on a combustion-infrared absorption method.

The contents of R, B, Ga, Cu, Al, M, Co, and Fe (at %) may be measured with an inductively coupled plasma emission spectroscopy (ICP-AES). The contents of R, B, Ga, Cu, Al, M and Co (at %) are expressed by a, b, c, d, e, f and g, respectively. Assuming that the total amount of elements that can be measured by ICP-AES is 100 at %, the Fe content (at %) can be calculated by an equation of 100-a-b-c-d-e-f-g.

Oxygen content α, nitrogen content β, and carbon content γ cannot be measured with ICP-AES. Therefore, the sum of a, b, c, d, e, f, g, (100-a-b-c-d-e-f-g), oxygen content α, nitrogen content β, and carbon content γ is allowed to exceed 100.

Measurements of Grain Size and Thickness of the Grain Boundary Phase:

Grain size and thickness of the grain boundary phase can be measured with a field emission scanning electron microscope (FESEM). The magnification can be appropriately set according to the grain size and the thickness of the grain boundary phase of the object to be measured.

The sintered permanent magnet is ground; its cross-section is observed after polishing. In general, there are three methods for measuring an average size of grains: a comparison method, an area method, and an intercept point method. The area method is applied in the present disclosure. In the area method, the number of grains in a known area is calculated, and the level of grain size is obtained according to the number of grains in the unit area. Then, an average diameter of grains can be calculated according to the actual size of the sample, the number of grains in the intercepted area, the length of the intercepting line, and the magnification. The thickness of different grain boundary phases may be measured with FESEM. The thicknesses of 60-100 different inter-particle grain boundary phases are measured, and an arithmetic average of these thicknesses is calculated to obtain an average thickness of the grain boundary phases.

Measurement of Magnetic Properties:

Magnetic properties of the sintered body and the sintered permanent magnet are measured with a B-H magnetometer at room temperature. The remanence Br at room temperature, the coercive force $H_{cj}$ at room temperature, and the squareness ratio $Hk/H_{cj}$ at room temperature of the sintered body and the sintered permanent magnet may be obtained.

The sintered body sample is mechanically processed into a cylinder with a diameter of 10 mm and a height of 10 mm. The sintered permanent magnet sample is mechanically processed into a square piece with a length of 9 mm and a width of 9 mm. If the sintered permanent magnet sample has a thickness of less than or equal to 2 mm, 2-5 pieces of samples are needed to be stacked for the measurement.

EXAMPLES 1-13

(1) Preparation of a Sintered Body:

The raw materials were provided according to the formulation in Table 1. The formulation satisfied the following conditions A:

$R_aB_bGa_cCu_dAl_eM_fCo_gFe_{balance}$. R comprises at least one selected from the group consisting of Nd and Pr, and the percentage of (La+Ce) is less than 1.0 at %. M comprises at least one selected from the group consisting of Zr, Ti, and Nb. The characters a, b, c, d, e, f, g represent the atomic percentage of each element based on all elements in the sintered body.

The following steps were used to prepare the sintered body:

Smelting: the raw materials were smelted and the smelted raw materials were formed into a master alloy sheet with a thickness of 0.278 mm.

Powdering: the master alloy sheet was crushed into magnetic particles, and then magnetic particles were ground into magnetic powder with a D50 of 3.8 μm and D90/D10 of 3.8.

Shaping: the magnetic powder was pressed in an alignment magnetic field with a magnetic field intensity of 2.0 T into a compact with a density of 4 g/cm$^3$, and then the compact was isostatically pressed to obtain a green body.

Vacuum heat treatment: the green body was heat treated under conditions of a vacuum degree of $4.0\times10^{-3}$ Pa and a temperature of 1050° C. for 5h, and then heat treated under conditions of a vacuum degree of $4.0\times10^{-1}$ Pa and a temperature of 900° C. for 3 h. Finally, the green body was heat treated under conditions of a vacuum degree of $4.0\times10^{-1}$ Pa and a temperature of 500° C. for 5 h. The obtained product was cut into the sintered body with a thickness of 4 mm.

(2) Attachment to the Sintered Body:

A vacuum magnetron sputtering coating method was used to uniformly plate a Tb metal film onto the surface of the sintered body to obtain a coated sintered body. The amount of Tb was 0.6 wt %, based on the weight of the sintered body.

(3) Heat Treatment:

The coated sintered body was heat treated under conditions of a vacuum degree of $1.5\times10^{-2}$ Pa and a temperature of 925° C. for 7 h, and then heat treated under conditions of a vacuum degree of $1.5\times10^{-2}$ Pa and a temperature of 495° C. for 5 h. A sintered permanent magnet was obtained. The measurement results were shown in Tables 1-3.

COMPARATIVE EXAMPLES 1-7

The raw materials were provided according to the formulation in Table 1. The formulation did not satisfy the condition A, while other conditions were the same as those in Example 1. The measurement results were shown in Tables 1-3.

TABLE 1

| No. | Sintered magnetic body (at %) | Oxygen content α (at %) | Nitrogen content β (at %) | Carbon content γ (at %) |
|---|---|---|---|---|
| Examples 1 | $Nd_{13.5}B_{5.6}Ga_{0.1}Cu_{0.1}Zr_{0.1}Co_{0.8}Fe_{balance}$* | 0.58 | 0.15 | 0.37 |
| Examples 2 | $Nd_{13.8}B_{5.75}Ga_{0.1}Cu_{0.2}Zr_{0.1}Co_{1.5}Fe_{balance}$ | 0.62 | 0.17 | 0.35 |
| Examples 3 | $Nd_{14.2}B_{5.75}Ga_{0.1}Cu_{0.3}Zr_{0.1}Ti_{0.05}Co_{1.8}Fe_{balance}$ | 0.59 | 0.21 | 0.35 |

TABLE 1-continued

| No. | Sintered magnetic body (at %) | Oxygen content α (at %) | Nitrogen content β (at %) | Carbon content γ (at %) |
|---|---|---|---|---|
| Examples 4 | $Nd_{14.5}B_{5.75}Ga_{0.1}Cu_{0.2}Zr_{0.12}Co_{2.2}Fe_{balance}$ | 0.66 | 0.23 | 0.39 |
| Examples 5 | $Nd_{14.8}B_{5.7}Ga_{0.1}Cu_{0.2}Zr_{0.1}Nb_{0.04}Co_{2.2}Fe_{balance}$ | 0.65 | 0.25 | 0.38 |
| Examples 6 | $Nd_{15}B_{5.7}Ga_{0.2}Cu_{0.2}Zr_{0.1}Ti_{0.05}Co_{1.0}Fe_{balance}$ | 0.62 | 0.28 | 0.42 |
| Examples 7 | $Nd_{15.2}B_{5.7}Ga_{0.1}Cu_{0.2}Zr_{0.12}Co_{1.8}Fe_{balance}$ | 0.69 | 0.31 | 0.44 |
| Comparative examples 1 | $Nd_{12.8}B_{5.7}Ga_{0.1}Cu_{0.2}Zr_{0.12}Co_{1.5}Fe_{balance}$ | 0.63 | 0.25 | 0.37 |
| Comparative examples 2 | $Nd_{15.6}B_{5.7}Ga_{0.19}Cu_{0.2}Zr_{0.1}Co_{1.5}Fe_{balance}$ | 0.72 | 0.37 | 0.58 |
| Examples 8 | $Nd_{14.8}B_{5.6}Ga_{0.1}Cu_{0.2}Zr_{0.14}Co_{1.0}Fe_{balance}$ | 0.64 | 0.26 | 0.39 |
| Examples 9 | $Nd_{14.5}B_{5.4}Ga_{0.1}Cu_{0.2}Zr_{0.12}Co_{2.2}Fe_{balance}$ | 0.66 | 0.24 | 0.36 |
| Examples 10 | $Nd_{14.6}B_{5.7}Ga_{0.1}Cu_{0.1}Al_{0.2}Zr_{0.12}Co_{0.8}Fe_{balance}$ | 0.67 | 0.25 | 0.35 |
| Examples 11 | $Nd_{14.7}B_{5.7}Ga_{0.1}Cu_{0.2}Al_{0.6}Zr_{0.12}Co_{1.8}Fe_{balance}$ | 0.65 | 0.23 | 0.37 |
| Examples 12 | $(PrNd)_{14.1}B_{5.75}Ga_{0.2}Cu_{0.1}Al_{0.9}Ti_{0.1}Co_{1.2}Fe_{balance}$** | 0.57 | 0.24 | 0.35 |
| Examples 13 | $(PrNd)_{15.2}B_{5.7}Ga_{0.2}Cu_{0.2}Al_{1.2}Zr_{0.12}Co_{1.8}Fe_{balance}$** | 0.69 | 0.30 | 0.41 |
| Comparative examples 3 | $Nd_{14.0}B_{5.3}Ga_{0.8}Cu_{0.12}Al_{0.5}Zr_{0.08}Co_{1.2}Fe_{balance}$ | 0.56 | 0.23 | 0.33 |
| Comparative examples 4 | $Nd_{14.0}B_{5.7}Cu_{0.3}Al_{0.7}Zr_{0.12}Co_{1.8}Fe_{balance}$ | 0.54 | 0.17 | 0.37 |
| Comparative examples 5 | $(PrNd)_{14.2}B_{5.3}Ga_{0.3}Cu_{0.3}Al_{1.5}Zr_{0.1}Ti_{0.05}Fe_{balance}$** | 0.56 | 0.19 | 0.34 |
| Comparative examples 6 | $Nd_{14.5}B_{5.75}Ga_{0.1}Cu_{0.2}Al_{1.3}Zr_{0.1}Co_{1.5}Fe_{balance}$ | 0.65 | 0.23 | 0.37 |
| Comparative examples 7 | $Nd_{14.8}B_{5.75}Ga_{0.1}Cu_{0.2}Al_{1.5}Zr_{0.12}Co_{0.8}Fe_{balance}$ | 0.64 | 0.27 | 0.38 |

*For convenience of expression, the subscript is used to express the value of the atomic percentage of each element multiplied by 100. For calculation, the atomic percentage of each element is still substituted into the formula.
** The atomic ratio of Pr to Nd is 25.44:74.56.

TABLE 2

| No. | Satisfy equation (2) | Satisfy equation (3) | Satisfy equation (4) |
|---|---|---|---|
| Examples 1 | Yes | Yes | Yes |
| Examples 2 | Yes | Yes | Yes |
| Examples 3 | Yes | Yes | Yes |
| Examples 4 | Yes | Yes | Yes |
| Examples 5 | Yes | Yes | Yes |
| Examples 6 | Yes | Yes | Yes |
| Examples 7 | Yes | Yes | Yes |
| Comparative examples 1 | Yes | Yes | Yes |
| Comparative examples 2 | No | Yes | Yes |
| Examples 8 | Yes | Yes | Yes |
| Examples 9 | Yes | Yes | Yes |
| Examples 10 | Yes | Yes | Yes |

TABLE 2-continued

| No. | Satisfy equation (2) | Satisfy equation (3) | Satisfy equation (4) |
|---|---|---|---|
| Examples 11 | Yes | Yes | Yes |
| Examples 12 | Yes | Yes | Yes |
| Examples 13 | Yes | Yes | Yes |
| Comparative examples 3 | Yes | Yes | No |
| Comparative examples 4 | Yes | Yes | No |
| Comparative examples 5 | Yes | No | No |
| Comparative examples 6 | Yes | No | Yes |
| Comparative examples 7 | Yes | No | Yes |

TABLE 3

| No. | Remanence of sintered body Br (kGs) | Coercive force of sintered body $H_{cj}$ (kOe) | Squareness ratio of sintered body $Hk/H_{cj}$ (%) | Remanence of sintered permanent magnet Br (kGs) | Coercive force of sintered permanent magnet $H_{cj}$ (kOe) | Squareness ratio of sintered permanent magnet $Hk/H_{cj}$ (%) |
|---|---|---|---|---|---|---|
| Examples 1 | 14.76 | 10.75 | 97.8 | 14.68 | 19.26 | 96.7 |
| Examples 2 | 14.71 | 12.48 | 98.1 | 14.65 | 21.24 | 96.6 |
| Examples 3 | 14.60 | 13.11 | 98.2 | 14.56 | 22.37 | 96.3 |
| Examples 4 | 14.45 | 14.42 | 98.5 | 14.40 | 24.1 | 96.5 |
| Examples 5 | 14.37 | 15.3 | 97.6 | 14.30 | 25.32 | 96.3 |
| Examples 6 | 14.21 | 16.38 | 98.1 | 14.14 | 26.72 | 96.1 |
| Examples 7 | 14.07 | 17.11 | 97.6 | 14.00 | 27.32 | 96.6 |
| Comparative examples 1 | 14.77 | 8.73 | 91 | 14.43 | 14.01 | 87.5 |
| Comparative examples 2 | 13.90 | 17.82 | 97.3 | 13.83 | 24.74 | 95.4 |
| Examples 8 | 14.22 | 16.52 | 97.8 | 14.11 | 26.35 | 96.9 |
| Examples 9 | 14.01 | 15.18 | 96.5 | 13.98 | 24.5 | 96.1 |
| Examples 10 | 14.24 | 15.62 | 98.6 | 14.17 | 25.65 | 96.5 |
| Examples 11 | 14.02 | 16.68 | 98.1 | 13.96 | 26.35 | 96.6 |
| Examples 12 | 13.85 | 15.23 | 97.6 | 13.77 | 24.36 | 96.3 |
| Examples 13 | 13.52 | 18.76 | 97.8 | 13.45 | 27.67 | 96.7 |

TABLE 3-continued

| No. | Remanence of sintered body Br (kGs) | Coercive force of sintered body $H_{cj}$ (kOe) | Squareness ratio of sintered body $Hk/H_{cj}$ (%) | Remanence of sintered permanent magnet Br (kGs) | Coercive force of sintered permanent magnet $H_{cj}$ (kOe) | Squareness ratio of sintered permanent magnet $Hk/H_{cj}$ (%) |
|---|---|---|---|---|---|---|
| Comparative examples 3 | 12.62 | 14.08 | 94 | 12.57 | 20.6 | 92 |
| Comparative examples 4 | 14.11 | 13.51 | 96 | 13.84 | 19.18 | 92.7 |
| Comparative examples 5 | 12.51 | 16.07 | 94.5 | 12.46 | 20.5 | 93.1 |
| Comparative examples 6 | 13.75 | 17.36 | 98.0 | 13.51 | 23.01 | 96.2 |
| Comparative examples 7 | 13.51 | 18.57 | 98.3 | 13.48 | 23.56 | 95.9 |

From the above tables, it can be seen that the content of R in the sintered body has a certain effect on the coercive force $H_{cj}$. From Comparative example 1 and Examples 1-7, it can be seen that for the sintered body and the sintered permanent magnet, the coercive force $H_{cj}$ of gradually increases as the content of R in the sintered body increases. From Comparative example 2, it can be seen that the percentages of primary phases in the sintered body and the sintered permanent magnet decrease when the content of R in the sintered body reaches 15.6at %. This limits an increase of the remanence Br, so both the sintered body and the sintered permanent magnet have a relatively low remanences Br. From Comparative example 1, it can be known that when the content of R in the sintered body is 12.8at %, and the contents of carbon, oxygen and nitrogen in the sintered body do not satisfy the equation (3), carbon, oxygen and nitrogen need to consume more rare earth elements, so that a sufficient continuous grain boundary phase may not be formed in the sintered body. Thus, both the sintered body and the sintered permanent magnet have a relatively low coercive force $H_{cj}$ and a relatively low squareness ratio $Hk/H_{cj}$.

From Comparative examples 3-5, it can be seen that when the contents of B and Ga of the sintered body do not satisfy the equation (4), both the sintered body and the sintered permanent magnet have a reduced coercive force $H_{cj}$ and a reduced squareness ratio $Hk/H_{cj}$. From Examples 1-13 and Comparative examples 3 and 5, it can be known that when the content of B in the sintered body is 5.3 at %, both the sintered body and the sintered permanent magnet have a relatively low remanence Br and a relatively low squareness ratio $Hk/H_{cj}$. From Examples 1-13 and Comparative example 4, it can be known that when the content of Ga in the sintered body is 0, both the sintered body and the sintered permanent magnet have a relatively low coercive force $H_{cj}$ and a slightly low squareness ratio $Hk/H_c$.

From the above tables, it can be seen that the content of R in the sintered body affects the diffusion efficiency of Tb. It can be known from Examples 1-7 that for the sintered permanent magnets obtained after Tb diffused into the sintered body, the coercive force increases respectively by 8.51 kOe, 8.76 kOe, 9.26 kOe, 10.02 kOe, 10.34 kOe or 10.21 kOe as the content of R in the sintered body gradually increases. For Comparative example 1, the content of R in the sintered body is so low (12.8 at %) that the coercive force of the sintered permanent magnet obtained after Tb diffused into the sintered body only increases by 5.28 kOe. For Comparative example 2, the content of R in the sintered body is so high (15.6 at %) that the coercive force of the sintered permanent magnet obtained after Tb diffused into the sintered body only increases by 6.92 kOe. For the magnet in Comparative example 2, the coercive force $H_{cj}$ increases slightly, but more rare earth elements R are used.

The contents of B and Ga in the sintered body also affect the diffusion efficiency of Tb. For Comparative examples 3 or 5, the contents of Ga in the sintered body are 0.8 at % or 0.3 at % respectively; however the content of B is 5.3 at %. Therefore, for the sintered permanent magnet obtained after Tb diffused into the sintered body, the coercive force $H_{cj}$ increases by 6.52 kOe or 4.43 kOe. For Comparative example 4, the content of B in the sintered body is 5.7 at %, but the content of Ga is 0, and thus the coercive force $H_{cj}$ increases by 5.67 kOe for the sintered permanent magnet obtained after Tb diffused into the sintered body. In contrast, the content of B in the sintered body is 5.6 at % and the content of Ga is 0.1 at % in Example 8, the coercive force $H_{cj}$ increases by 9.83 kOe for the sintered permanent magnet obtained after Tb diffused into the sintered body. The content of B in the sintered body is 5.4 at % and the content of Ga is 0.1 at % in Example 9, the coercive force $H_{cj}$ increases by 9.32 kOe for the sintered permanent magnet obtained after Tb diffused into the sintered body.

The Al content of the sintered body plays an important role on the diffusion efficiency of Tb. It can be known from Examples 10-13 and Comparative examples 6-7 that the diffusion efficiency of Tb becomes deteriorated as the content of Al in the sintered body increases. Thus, for the sintered permanent magnet obtained after Tb diffused into the sintered body, an increasing extent of the coercive force $H_{cj}$ decreases. For the sintered permanent magnets obtained after the Tb diffused into the sintered body in Examples 10-13, the coercive force $H_{cj}$ increases respectively by 10.03 kOe, 9.67 kOe, 9.13 kOe or 8.91 kOe. However, for the sintered permanent magnets obtained after the Tb diffused into the sintered body in Comparative examples 6-7, the coercive force $H_{cj}$ only increases respectively by 5.65 kOe or 4.99 kOe.

EXAMPLES 14-16

Examples 14-16 were different from Example 6 in that the product obtained in the vacuum heat treatment was cut into the sintered body with a thickness of 2 mm, 6 mm or 8 mm, respectively. Other conditions were the same as those in Example 6. Specific steps were as follows:

(1) Preparation of a Sintered Body:

The raw materials were provided according to the formulation in Table 1 (Example 6). The sintered body was prepared according to following steps:

Smelting: the raw materials were smelted and the smelted raw materials were formed into a master alloy sheet with a thickness of 0.278 mm.

Powdering: the master alloy sheet was crushed into magnetic particles, and then magnetic particles were ground into magnetic powder with a D50 of 3.8 μm and D90/D10 of 3.8.

Shaping: the magnetic powder was pressed in an alignment magnetic field with a magnetic field intensity of 2.0 T into a compact with a density of 4 g/cm$^3$, and then the compact was isostatically pressed to obtain a green body.

Vacuum heat treatment: The green body was heat treated under conditions of a vacuum degree of $4.0\times10^{-3}$ Pa and a temperature of 1050° C. for 5 h, and then heat treated under conditions of a vacuum degree of $4.0\times10^{-1}$ Pa and a temperature of 900° C. for 3 h. Finally, the green body was heat treated under conditions of a vacuum degree of $4.0\times10^{-1}$ Pa and a temperature of 500° C. for 5 h. The obtained product was cut into the sintered body with a thickness of 2 mm, 6 mm or 8 mm.

(2) Attachment to the Sintered Body:

A vacuum magnetron sputtering coating method was used to uniformly plate a Tb metal film onto the surface of the sintered body to obtain a coated sintered body. The amount of Tb was 0.6 wt %, based on the weight of the sintered body.

(3) Heat Treatment:

The coated sintered body was heat treated under conditions of a vacuum degree of $1.5\times10^{-2}$ Pa and a temperature of 925° C. for 7 h, and then heat treated under conditions of a vacuum degree of $1.5\times10^{-2}$ Pa and a temperature of 495° C. for 5 h. A sintered permanent magnet was obtained. The specific conditions were shown in Table 4. The measurement results were shown in Table 5.

TABLE 4

| No. | Thickness of sintered body (mm) | Processing time of heat treatment (h) |
|---|---|---|
| Example 14 | 2 | 7 |
| Example 6 | 4 | 7 |
| Example 15 | 6 | 7 |
| Example 16 | 8 | 7 |

TABLE 5

| No. | Remanence of sintered permanent magnet Br (kGs) | Coercive force of sintered permanent magnet $H_{cj}$ (kOe) | Squareness ratio of sintered permanent magnet $Hk/H_{cj}$ (%) | Increasing extent of coercive force $\Delta H_{cj}$ (kOe) |
|---|---|---|---|---|
| Example 14 | 14.13 | 26.9 | 97.1 | 10.52 |
| Example 6 | 14.14 | 26.72 | 96.1 | 10.34 |

TABLE 5-continued

| No. | Remanence of sintered permanent magnet Br (kGs) | Coercive force of sintered permanent magnet $H_{cj}$ (kOe) | Squareness ratio of sintered permanent magnet $Hk/H_{cj}$ (%) | Increasing extent of coercive force $\Delta H_{cj}$ (kOe) |
|---|---|---|---|---|
| Example 15 | 14.18 | 25.55 | 95.7 | 9.17 |
| Example 16 | 14.19 | 24.69 | 95.2 | 8.31 |

*$\Delta H_{cj}$ represents the difference between the coercive force of the sintered permanent magnet and that of the sintered body. The same applies hereinafter.

It can be seen from the above table that the thickness of the sintered body affects the diffusion of Tb. As the thickness of the sintered body increases, the coercive force $H_{cj}$ of the sintered permanent magnet obtained after Tb diffused into the sintered body decreases. For Examples 14-16 and Example 6, the coercive force increases respectively by 10.52 kOe, 9.17 kOe, 8.31 kOe or 10.34 kOe.

EXAMPLES 17-22

Examples 17-22 were different from Example 6 in that the product obtained in the vacuum heat treatment was cut into the sintered body with a thickness of 2 mm; the processing times of the heat treatment step were 1 h, 3 h, 5 h, 10 h, 15 h or 20 h, respectively. Specific steps were as follows:

(1) Preparation of a Sintered Body:

The raw materials were provided according to the formulation in Table 1 (Example 6). The sintered body was prepared according to following steps:

Smelting: the raw materials were smelted and the smelted raw materials were formed into a master alloy sheet with a thickness of 0.278 mm.

Powdering: the master alloy sheet was crushed into magnetic particles, and then magnetic particles were ground into magnetic powder with a D50 of 3.85 μm and D90/D10 of 4.03.

Shaping: the magnetic powder was pressed in an alignment magnetic field with a magnetic field intensity of 2.0 T into a compact with a density of 4 g/cm$^3$, and then the compact was isostatically pressed to obtain a green body.

Vacuum heat treatment: the green body was heat treated under conditions of a vacuum degree of $4.0\times10^{-1}$ Pa and a temperature of 1050° C. for 5 h, and then heat treated under conditions of a vacuum degree of $4.0\times10^{-1}$ Pa and a temperature of 900° C. for 3 h. Finally, the green body was heat treated under conditions of a vacuum degree of $4.0\times10^{-1}$ Pa and a temperature of 500° C. for 5 h. The obtained product was cut into the sintered body with a thickness of 2 mm.

(2) Attachment to the Sintered Body:

A vacuum magnetron sputtering coating method was used to uniformly plate a Tb metal film onto the surface of the sintered body to obtain a coated sintered body. The amount of Tb was 0.6 wt %, based on the weight of the sintered body.

(3) Heat Treatment:

The coated sintered body was heat treated under conditions of a vacuum degree of $1.5\times10^{-2}$ Pa and a temperature of 925° C. for different processing times of 1 h, 3 h, 5 h, 10 h, 15 h or 20 h, and then heat treated under conditions of a vacuum degree of $1.5\times10^{-2}$ Pa and a temperature of 495° C. for 5 h. A sintered permanent magnet was obtained. The specific conditions were shown in Table 6. The measurement results were shown in Table 7.

COMPARATIVE EXAMPLES 8-14

Comparative examples 8-14 were different from Comparative example 5 in that the product obtained in the vacuum heat treatment step was cut into a sintered body with a thickness of 2 mm; the processing times of the heat treatment step were 1 h, 3 h, 5 h, 10 h, 15 h or 20 h, respectively. Other conditions were the same as those in Comparative example 5. Specific steps were as follows:

(1) Preparation of a Sintered Body:

The raw materials were provided according to the formulation in Table 1 (Comparative example 5). The sintered body was prepared according to following steps:

Smelting: the raw materials were smelted and the smelted raw materials were formed into a master alloy sheet with a thickness of 0.289 mm;

Powdering: the master alloy sheet was crushed into magnetic particles, and then magnetic particles were ground into magnetic powder with a D50 of 4.12 μm and D90/D10 of 4.16.

Shaping: the magnetic powder was pressed in an alignment magnetic field with a magnetic field intensity of 2.0 T into a compact with a density of 4 g/cm$^3$, and then the compact was isostatically pressed to obtain a green body.

Vacuum heat treatment: The green body was heat treated under conditions of a vacuum degree of $4.0\times10^{-3}$ Pa and a temperature of 1060° C. for 5 h, and then heat treated under conditions of a vacuum degree of $4.0\times10^{-1}$ Pa and a temperature of 900° C. for 3 h. Finally, the green body was heat treated under conditions of a vacuum degree of $4.0\times10^{-1}$ Pa and a temperature of 520° C. for 5 h. The obtained product was cut into the sintered body with a thickness of 2 mm.

(2) Attachment to the Sintered Body:

A vacuum magnetron sputtering coating method was used to uniformly plate a Tb metal film onto the surface of the sintered body to obtain a coated sintered body. The amount of Tb was 0.6 wt %, based on the weight of the sintered body.

(3) Heat Treatment:

The coated sintered body was heat treated under conditions of a vacuum degree of $1.5\times10^{-2}$ Pa and a temperature of 925° C. for different processing times of 1 h, 3 h, 5 h, 10 h, 15 h or 20 h, and then heat treated under conditions of a vacuum degree of $1.5\times10^{-2}$ Pa and a temperature of 490° C. for 5 h. A sintered permanent magnet was obtained. The specific conditions were shown in Table 6. The measurement results were shown in Table 7.

TABLE 6

| No. | Thickness of sintered body (mm) | Processing time of heat treatment (h) |
|---|---|---|
| Example 17 | 2 | 1 |
| Example 18 | | 3 |
| Example 19 | | 5 |
| Example 14 | | 7 |
| Example 20 | | 10 |
| Example 21 | | 15 |
| Example 22 | | 20 |
| Comparative example 8 | 2 | 1 |
| Comparative example 9 | | 3 |
| Comparative example 10 | | 5 |
| Comparative example 11 | | 7 |
| Comparative example 12 | | 10 |
| Comparative example 13 | | 15 |
| Comparative example 14 | | 20 |

TABLE 7

| No. | Remanence of sintered permanent magnet Br (kGs) | Coercive force of sintered permanent magnet $H_{cj}$ (kOe) | Squareness ratio of sintered permanent magnet $Hk/H_{cj}$ (%) | Increasing extent of coercive force $\Delta H_{cj}$ (kOe) |
|---|---|---|---|---|
| Example 17 | 14.16 | 26.06 | 97.3 | 9.68 |
| Example 18 | 14.15 | 26.89 | 97.1 | 10.51 |
| Example 19 | 14.15 | 26.87 | 96.8 | 10.49 |
| Example 14 | 14.13 | 26.9 | 97.1 | 10.52 |
| Example 20 | 14.13 | 26.83 | 96.9 | 10.45 |
| Example 21 | 14.11 | 26.79 | 96.5 | 10.41 |
| Example 22 | 14.11 | 26.81 | 96.4 | 10.43 |
| Comparative example 8 | 12.48 | 20.05 | 93.9 | 3.98 |
| Comparative example 9 | 12.48 | 20.58 | 94.1 | 4.51 |
| Comparative example 10 | 12.46 | 20.86 | 93.4 | 4.79 |
| Comparative example 11 | 12.46 | 20.89 | 93.4 | 4.82 |
| Comparative example 12 | 12.45 | 20.87 | 93.2 | 4.80 |
| Comparative example 13 | 12.46 | 20.85 | 93.3 | 4.78 |
| Comparative example 14 | 12.44 | 20.86 | 93.1 | 4.79 |

It can be seen from the above table, for the sintered permanent magnets obtained after Tb diffused into the sintered body, the variation trend of an increasing extent of coercive force ($\Delta H_{cj}$) in Examples 17-22 is the same with that in Comparative Examples 8-14, as the processing time of heat treatment extends. That is to say, $\Delta H_{cj}$, increases firstly, and then levels off. For Examples 17-22, $\Delta H_{cj}$ is relatively large. When the processing time of heat treatment is about 3 h, $\Delta H_{cj}$ reaches the maximum. For Comparative examples 8-14, $\Delta H_{cj}$, is relatively small When the processing time of heat treatment is 5-7 h, $\Delta H_{cj}$ reaches the maximum. It can be seen that the sintered body of the present disclosure is more favorable for diffusion of Tb, with a higher diffusion rate.

EXAMPLES 23-28

Examples 23-28 were different from Example 6 in that the processing times of heat treatment step were 1 h, 3 h, 5 h, 10 h, 15 h or 20 h, respectively. Specific steps are as follows:

(1) Preparation of a Sintered Body:

The raw materials were provided according to the formulation in Table 1 (Example 6). The sintered body was prepared according to following steps:

Smelting: the raw materials were smelted and the smelted raw materials were formed into a master alloy sheet with a thickness of 0.278 mm.

Powdering: the master alloy sheet was crushed into magnetic particles, and then magnetic particles were ground into magnetic powder with a D50 of 3.85 μm and D90/D10 of 4.03.

Shaping: the magnetic powder was pressed in an alignment magnetic field with a magnetic field intensity of 2.0 T into a compact with a density of 4 g/cm$^3$, and then the compact was isostatically pressed to obtain a green body.

Vacuum heat treatment: the green body was heat treated under conditions of a vacuum degree of $4.0\times10^{-3}$ Pa and a temperature of 1050° C. for 5 h, and then heat treated under conditions of a vacuum degree of $4.0\times10^{-1}$ Pa and a temperature of 900° C. for 3 h. Finally, the green body was heat treated under conditions of a vacuum degree of $4.0\times10^{-1}$ Pa and a temperature of 500° C. for 5 h. The obtained product was cut into the sintered body with a thickness of 4 mm.

(2) Attachment to the Sintered Body:

A vacuum magnetron sputtering coating method was used to uniformly plate a Tb metal film onto the surface of the sintered body to obtain a coated sintered body. The amount of Tb was 0.6 wt %, based on the weight of the sintered body.

(3) Heat Treatment:

The coated sintered body was heat treated under conditions of a vacuum degree of $1.5\times10^{-2}$ Pa and a temperature of 925° C. for different processing times of 1 h, 3 h, 5 h, 10 h, 15 h or 20 h, and then heat treated under conditions of a vacuum degree of $1.5\times10^{-2}$Pa and a temperature of 495° C. for 5 h. A sintered permanent magnet was obtained. The specific conditions were shown in Table 8. The measurement results were shown in Table 9.

COMPARATIVE EXAMPLES 15-20

Comparative examples 15-20 were different from Comparative example 5 in that the processing times of the heat treatment step were 1 h, 3 h, 5 h, 10 h, 15 h or 20 h, respectively. Other conditions were the same as those in Comparative example 5. Specific steps were as follows:

(1) Preparation of a Sintered Body:

The raw materials were provided according to the formulation of Table 1 (Comparative example 5). The sintered body was prepared according to following steps:

Smelting: the raw materials were smelted and the smelted raw materials were formed into a master alloy sheet with a thickness of 0.289 mm;

Powdering: the master alloy sheet was crushed into magnetic particles, and then magnetic particles were ground into magnetic powder with a D50 of 4.12 μm and D90/D10 of 4.16.

Shaping: the magnetic powder was pressed in an alignment magnetic field with a magnetic field intensity of 2.0 T into a compact with a density of 4 g/cm$^3$, and then the compact was isostatically pressed to obtain a green body.

Vacuum heat treatment: the green body was heat treated under conditions of a vacuum degree of $4.0\times10^{-3}$ Pa and a temperature of 1060° C. for 5 h, and then heat treated under conditions of a vacuum degree of $4.0\times10^{-1}$ Pa and a temperature of 900° C. for 3 h. Finally, the green body was heat treated under conditions of a vacuum degree of $4.0\times10^{-1}$ Pa and a temperature of 520° C. for 5 h. The obtained product was cut into the sintered body with a thickness of 4 mm.

(2) Attachment to the Sintered Body:

A vacuum magnetron sputtering coating method was used to uniformly plate a Tb metal film onto the surface of the sintered body to obtain a coated sintered body. The amount of Tb was 0.6 wt %, based on the weight of the sintered body.

(3) Heat Treatment:

The coated sintered body was heat treated under conditions of a vacuum degree of $1.5\times10^{-2}$ Pa and a temperature of 925° C. for different processing times of 1 h, 3 h, 5 h, 10 h, 15 h or 20 h, and then heat treated under conditions of a vacuum degree of $1.5\times10^{-2}$ Pa and a temperature of 490° C. for 5 h. A sintered permanent magnet was obtained.

TABLE 8

| No. | Thickness of sintered body (mm) | Processing time of heat treatment (h) |
|---|---|---|
| Example 23 | 4 | 1 |
| Example 24 | | 3 |
| Example 25 | | 5 |
| Example 6 | | 7 |
| Example 26 | | 10 |
| Example 27 | | 15 |
| Example 28 | | 20 |
| Comparative example 15 | 4 | 1 |
| Comparative example 16 | | 3 |
| Comparative example 17 | | 5 |
| Comparative example 5 | | 7 |
| Comparative example 18 | | 10 |
| Comparative example 19 | | 15 |
| Comparative example 20 | | 20 |

TABLE 9

| No. | Remanence of sintered permanent magnet Br (kGs) | Coercive force of sintered permanent magnet $H_{cj}$ (kOe) | Squareness ratio of sintered permanent magnet Hk/$H_{cj}$ (%) | Increasing extent of coercive force $\Delta H_{cj}$ (kOe) |
|---|---|---|---|---|
| Example 23 | 14.18 | 24.93 | 96.7 | 8.55 |
| Example 24 | 14.17 | 26.25 | 96.4 | 9.87 |
| Example 25 | 14.17 | 26.61 | 96.6 | 10.23 |
| Example 6 | 14.14 | 26.72 | 96.1 | 10.34 |
| Example 26 | 14.12 | 26.73 | 96.3 | 10.35 |
| Example 27 | 14.10 | 26.68 | 95.9 | 10.30 |
| Example 28 | 14.10 | 26.63 | 95.7 | 10.25 |
| Comparative example 15 | 12.47 | 18.69 | 93.0 | 2.62 |
| Comparative example 16 | 12.48 | 19.78 | 93.1 | 3.71 |
| Comparative example 17 | 12.45 | 20.24 | 92.8 | 4.17 |
| Comparative example 5 | 12.51 | 16.07 | 94.5 | 4.43 |
| Comparative example 18 | 12.45 | 20.51 | 93.1 | 4.41 |
| Comparative example 19 | 12.43 | 20.48 | 93.2 | 4.45 |
| Comparative example 20 | 12.44 | 20.52 | 92.7 | 4.45 |

It can be seen from the above table, for the sintered permanent magnets obtained after Tb diffused into the sintered body in Examples 23-28, Example 6, Comparative examples 15-20 and Comparative example 5, their variation trend of an increasing extent of coercive force ($\Delta H_{cj}$) are the same as the processing time of heat treatment extends. That is to say, $\Delta H_{cj}$, increases firstly, and then levels off. For Examples 23-28, $\Delta H_{cj}$, is relatively large. When the processing time of heat treatment is about 7 h, $\Delta H_{cj}$, reaches the maximum. For Comparative examples 15-20, $\Delta H_{cj}$, is relatively small When the processing time of heat treatment is about 15 h, $\Delta H_{cj}$, reaches the maximum. It can be seen that the sintered body of the present disclosure is more favorable for diffusion of Tb, with a higher diffusion rate.

EXAMPLES 29-31 AND COMPARATIVE EXAMPLES 21-24

Examples 29-31 were different from Comparative examples 21-24 in the magnetic particle sizes D50 and D90/D10. The formulations of raw materials for Examples 29-31 and Comparative examples 21-24 were $Nd_{14.8}N_{5.7}Ga_{0.1}Cu_{0.2}Zr_{0.14}Co_{2.2}Fe_{balance}$; the average thickness of the master alloy sheet for preparing the sintered body was 0.282 mm; the magnetic powder had a particle size D50 of 3.82 μm, 4.05 μm, 4.25 μm, 3.01 μm, 3.27 μm, 4.48 μm or 4.93 μm, respectively, and it had D90/D10 of 4.06, 4.18, 4.27, 3.92, 3.96, 4.45 or 4.68, respectively. The detailed steps were as follows:

(1) Preparation of a Sintered Body:

The raw materials were provided according to the formulation expressed by a composition formula $Nd_{14.8}B_{5.7}Ga_{0.1}Cu_{0.2}Zr_{0.14}Co_{2.2}Fe_{balance}$.

Smelting: the raw materials were smelted and the smelted raw materials were formed into a master alloy sheet with a thickness of 0.282 mm;

Powdering: the master alloy sheet was crushed into magnetic particles and then magnetic particles were ground into magnetic powder. For Examples 35-37 and Comparative examples 22-25, the magnetic powder had a particle size D50 of 3.82 μm, 4.05 μm, 4.25 μm, 3.01 μm, 3.27 μm, 4.48 μm or 4.93 μm, respectively, and it had D90/D10 of 4.06, 4.18, 4.27, 3.92, 3.96, 4.45 or 4.68, respectively. The parameters were given in detail in Table 10.

Shaping: the magnetic powder was pressed in an alignment magnetic field with a magnetic field intensity of 2.0 T into a compact with a density of 4 g/cm$^3$, and then the compact was isostatically pressed to obtain a green body.

Vacuum heat treatment: the green body was heat treated under conditions of a vacuum degree of $4.0\times10^{-3}$ Pa and a temperature of 1050° C. for 5 h, and then heat treated under conditions of a vacuum degree of $4.0\times10^{-1}$ Pa and a temperature of 900° C. for 3 h. Finally, the green body was heat treated under conditions of a vacuum degree of $4.0\times10^{-1}$ Pa and a temperature of 500° C. for 5 h. The obtained product was cut into the sintered body with a thickness of 4 mm.

(2) Attachment to the Sintered Body:

A vacuum magnetron sputtering coating method was used to uniformly plate a Tb metal film onto the surface of the sintered body to obtain a coated sintered body. The amount of Tb was 0.6 wt %, based on the weight of the sintered body.

(3) Heat Treatment:

The coated sintered body was heat treated under conditions of a vacuum degree of $1.5\times10^{-2}$ Pa and a temperature of 925° C. for different processing times of 7 h, and then heat treated under conditions of a vacuum degree of $1.5\times10^{-2}$ Pa and a temperature of 495° C. for 5 h. A sintered permanent magnet was obtained. The measurement results were shown in Tables 11-12.

TABLE 10

| No. | D50 (μm) | D90/D10 | Oxygen content α (at %) | Nitrogen content β (at %) | Carbon content γ (at %) |
|---|---|---|---|---|---|
| Example 29 | 3.82 | 4.06 | 0.65 | 0.32 | 0.40 |
| Example 30 | 4.05 | 4.18 | 0.62 | 0.31 | 0.36 |
| Example 31 | 4.25 | 4.27 | 0.65 | 0.27 | 0.33 |
| Comparative example 21 | 3.01 | 3.92 | 0.71 | 0.36 | 0.43 |
| Comparative example 22 | 3.27 | 3.96 | 0.69 | 0.33 | 0.39 |
| Comparative example 23 | 4.48 | 4.45 | 0.58 | 0.25 | 0.32 |
| Comparative example 24 | 4.93 | 4.68 | 0.54 | 0.19 | 0.32 |

TABLE 11

| No. | Average size of grains in sintered body L(μm) | Thickness of grain boundary phase in sintered body t (μm) | σ = t/L | Satisfy equation (1) | Satisfy equation (2) | Satisfy equation (3) | Satisfy equation (4) |
|---|---|---|---|---|---|---|---|
| Example 29 | 5.16 | 0.049 | 0.0095 | Yes | Yes | Yes | Yes |
| Example 30 | 6.28 | 0.064 | 0.0102 | Yes | Yes | Yes | Yes |
| Example 31 | 7.36 | 0.078 | 0.0106 | Yes | Yes | Yes | Yes |
| Comparative example 21 | 3.57 | 0.025 | 0.0070 | No | Yes | Yes | Yes |
| Comparative example 22 | 3.83 | 0.030 | 0.0078 | No | Yes | Yes | Yes |
| Comparative example 23 | 8.18 | 0.108 | 0.0132 | No | Yes | Yes | Yes |
| Comparative example 24 | 8.65 | 0.135 | 0.0158 | No | Yes | Yes | Yes |

TABLE 12

| No. | Remanence of sintered body Br (kGs) | Coercive force of sintered body $H_{cj}$ (kOe) | Squareness ratio of sintered body $Hk/H_{cj}$ (%) | Remanence of sintered permanent magnet Br (kGs) | Coercive force of sintered permanent magnet $H_{cj}$ (kOe) | Squareness ratio of sintered permanent magnet $Hk/H_{cj}$ (%) |
|---|---|---|---|---|---|---|
| Example 29 | 14.39 | 16.24 | 97.8 | 14.37 | 25.55 | 96.5 |
| Example 30 | 14.37 | 15.88 | 97.6 | 14.35 | 26.02 | 96.7 |
| Example 31 | 14.42 | 15.56 | 98.1 | 14.41 | 25.23 | 97.3 |
| Comparative example 21 | 14.40 | 17.42 | 98.0 | 14.28 | 23.18 | 96.8 |
| Comparative example 22 | 14.41 | 16.73 | 97.6 | 14.31 | 23.69 | 96.9 |
| Comparative example 23 | 14.39 | 15.22 | 97.8 | 14.36 | 21.53 | 96.0 |
| Comparative example 24 | 14.38 | 14.54 | 98.3 | 14.33 | 19.86 | 95.9 |

It can be seen from the above tables, σ (=t/L) also affects the diffusion efficiency of Tb. As the particle size D50 of the magnetic powder increases, the average thickness t of the grain boundary phase gradually increases. For the sintered permanent magnet obtained after Tb diffused into the sintered body in Examples 29-31 which meet the requirements of equation (1), the coercive force $H_{cj}$ increases by 9.31 kOe, 10.14 kOe or 9.67 kOe, respectively. For the sintered permanent magnet obtained after Tb diffused into the sintered body in Comparative examples 21-24 which do not satisfy the requirements of equation (1), the coercive forces $H_{cj}$ increases by 5.76 kOe, 6.96 kOe, 6.31 kOe or 5.32 kOe, respectively.

COMPARATIVE EXAMPLE 25

Comparative example 25 was different from Example 6 in that the third vacuum heat treatment was omitted. The specific steps were as follows:

(1) Preparation of a Sintered Body:

The raw materials were provided according to the formulation expressed by a composition formula $Nd_{15}B_{5.7}Ga_{0.2}Cu_{0.2}Zr_{0.1}Ti_{0.05}Co_{1.0}Fe_{balance}$. The sintered body was prepared according to the following steps:

Smelting: the raw materials were smelted and the smelted raw materials were formed into a master alloy sheet with a thickness of 0.278 mm.

Powdering: the master alloy sheet was crushed into magnetic particles, and then magnetic particles were ground into magnetic powder with a D50 of 3.85 μm and D90/D10 of 4.03.

Shaping: the magnetic powder was pressed in an alignment magnetic field with a magnetic field intensity of 2.0 T into a compact with a density of 4 g/cm$^3$, and then the compact was isostatically pressed to obtain a green body.

Vacuum heat treatment: the green body was heat treated under conditions of a vacuum degree of $4.0\times10^{-3}$ Pa and a temperature of 1050° C. for 5 h, and then heat treated under conditions of a vacuum degree of $4.0\times10^{-1}$ Pa and a temperature of 900° C. for 3 h. The obtained product was cut into the sintered body with a thickness of 4 mm.

(2) Attachment to the Sintered Body:

A vacuum magnetron sputtering coating method was used to uniformly plate a Tb metal film onto the surface of the sintered body to obtain a coated sintered body. The amount of Tb was 0.6 wt %, based on the weight of the sintered body.

(3) Heat Treatment:

The coated sintered body was heat treated under conditions of a vacuum degree of $1.5\times10^{-2}$ Pa and a temperature of 925° C. for 7 h, and then heat treated under conditions of a vacuum degree of $1.5\times10^{-2}$ Pa and a temperature of 495° C. for 5 h. A sintered permanent magnet was obtained. The measurement results were shown in Table 13.

TABLE 13

| No. | Remanence of sintered body Br (kGs) | Coercive force of sintered body $H_{cj}$ (kOe) | Squareness ratio of sintered body $Hk/H_{cj}$ (%) | Remanence of sintered permanent magnet Br (kGs) | Coercive force of sintered permanent magnet $H_{cj}$ (kOe) | Squareness ratio of sintered permanent magnet $Hk/H_{cj}$ (%) |
|---|---|---|---|---|---|---|
| Example 6 | 14.21 | 16.38 | 98.1 | 14.14 | 26.72 | 96.1 |
| Comparative example 25 | 14.32 | 14.87 | 98.2 | 14.16 | 25.13 | 96.3 |

It can be seen from the above tables, for the sintered permanent magnets obtained after Tb diffused into the sintered body, the increasing extent of coercive force ($\Delta H_{cj}$) in Example 6 is similar to that in Comparative example 25. $\Delta H_{cj}$ is 10.34 kOe for Example 6, and $\Delta H_{cj}$ is 10.26 kOe for Comparative example 25. However, the coercive force $H_{cj}$ of the sintered permanent magnet in Comparative example 25 is lower than that of the sintered permanent magnet in Example 6. It means that the method of vacuum heat treatment significantly affects the coercive force $H_{cj}$.

What is claimed is:

1. A method for preparing the sintered permanent magnet, comprising the following steps:

(1) providing raw materials according to a composition of a sintered body;

wherein the sintered body comprises $Nd_2Fe_{14}B$ crystal phase as a primary phase and a rare earth rich phase as a grain boundary phase and has the composition expressed by a composition formula $(PrNd)_{15.2}B_{5.7}Ga_{0.2}Cu_{0.2}Al_{1.2}Zr_{0.12}Co_{1.8}Fe_{balance}$ with an atomic ratio of Pr to Nd of 25. 44:74.56, wherein in the sintered body, an atomic percentage of oxygen $\alpha$ is 0.69%, an atomic percentage of nitrogen $\beta$ is 0.30% and an atomic percentage of carbon $\gamma$ is 0.41%;

(2) smelting the raw materials to obtain a master alloy sheet with a thickness of 0.278 mm;

(3) crushing the master alloy sheet into magnetic particles, grounding the magnetic particles into magnetic powder with a D50 of 3.8 μm and D90/D10 of 3.8;

(4) pressing the magnetic powder in an alignment magnetic field with a magnetic field intensity of 2.0 T into a compact with a density of 4 g/cm$^3$, and then isostatically pressing the compact to obtain a green body;

(5) heat treating the green body under conditions of a vacuum degree of $4.0\times10^{-3}$ Pa and a temperature of 1050° C. for 5 h, and then heat treating under conditions of a vacuum degree of $4.0\times10^{-1}$ Pa and a temperature of 900° C. for 3 h, and finally heat treating under conditions of a vacuum degree of $4.0\times10^{-1}$ Pa and a temperature of 500° C. for 5 h to obtain a product; cutting the product into a sintered body with a thickness of 4 mm;

(6) using a vacuum magnetron sputtering coating method to uniformly plate a Tb metal film onto a surface of the sintered body to obtain a coated sintered body; wherein a amount of Tb is 0.6 wt %, based on the weight of the sintered body;

(7) heat treating the coated sintered body under conditions of a vacuum degree of $1.5\times10^{-2}$ Pa and a temperature of 925° C. for 7 h, and then heat treating under conditions of a vacuum degree of $1.5\times10^{-2}$ Pa and a temperature of 495° C. for 5 h to obtain a sintered permanent magnet with a coercive force of 27.67 kOe.

* * * * *